US005356151A

United States Patent [19]

Abecassis

[11] Patent Number: 5,356,151

[45] Date of Patent: Oct. 18, 1994

[54] GAMEBOARD AND SCALE MODEL GAME

[76] Inventor: Max Abecassis, 19020 NE. 20 Ave., Miami, Fla. 33179

[21] Appl. No.: 50,556

[22] Filed: Apr. 20, 1993

[51] Int. Cl.[5] ..... A63F 3/00

[52] U.S. Cl. ..... 273/243; 273/237

[58] Field of Search ..... 273/242, 243, 276, 237, 273/138 A, 238, 248, 249

[56] References Cited

U.S. PATENT DOCUMENTS

| | | | |
|---|---|---|---|
| 2,026,082 | 12/1935 | Darrow . | |
| 2,456,098 | 12/1948 | Wheeler | 273/276 X |
| 2,620,192 | 12/1952 | Housley | 273/276 X |
| 3,468,540 | 9/1969 | Mulligan | 273/276 X |
| 3,558,136 | 1/1971 | McFarland . | |
| 3,738,659 | 6/1973 | Partridge | 273/276 X |
| 3,779,558 | 1/1974 | Moreau . | |
| 3,850,433 | 11/1974 | Purlia . | |
| 4,014,554 | 3/1977 | Krummacher . | |
| 4,417,732 | 11/1983 | Guill . | |
| 4,484,748 | 11/1984 | Becze . | |
| 4,674,752 | 6/1987 | Brothers | 273/276 X |
| 4,801,147 | 1/1989 | Miller | 273/276 |
| 4,907,808 | 3/1990 | Turner et al. | 273/276 X |
| 4,950,912 | 8/1990 | Goldfarb et al. | 273/276 X |
| 4,955,617 | 9/1990 | Mason, Jr. et al. | 273/276 X |
| 5,031,914 | 7/1991 | Rosenthal | 273/138 A |
| 5,071,136 | 12/1991 | Lott . | |
| 5,076,588 | 12/1991 | Minh . | |
| 5,141,235 | 8/1992 | Hernandez . | |
| 5,149,098 | 9/1992 | Bianchi . | |
| 5,178,391 | 1/1993 | Schoen . | |

*Primary Examiner*—William E. Stoll

[57] ABSTRACT

A playing apparatus including a plurality of representative components each representative of one of a plurality of computer components, each of the representative components structured for assembly as a completed structure, a gameboard defining a playing area, the playing area including a plurality of identified player positions disposed in spaced relation to one another and defining a pathway, at least some of the player positions being located within one of a plurality of component areas within the playing area, each of the components areas identifying one of the plurality of representative components, the playing area further including directions for assembling the plurality of representative components. Player markers are provided for identifying the position of each player on the gameboard, wherein the amount of movement of the player markers along a pathway is determined by rolling dice or by an electronic device that provides a name randomly selected from the names of each of the plurality of representative components. The individual components are accumulated by each player as per the game instructions that establish the distribution of representative components as a player's marker progresses about the pathway. Other enhancements include electrical circuit and indicator for indicating complete and correct assembly of the components, and a logo identifying at least one of a plurality of actual computer component manufacturers.

7 Claims, 7 Drawing Sheets

GAMEBOARD AND SCALE MODEL GAME

TECHNOLOGY-THEMED PLAYING SYSTEM

A portion of the disclosure of this patent document contains material which is subject to copyright protection. The copyright owner has no objection to the facsimile reproduction by any one of the patent disclosure, as it appears in the Patent and Trademark Office patent files or records, but otherwise reserves all copyright rights whatsoever.

BACKGROUND OF THE INVENTION

1. Field of the Invention

The present invention relates to puzzles, game boards, collectable cards, model kits, gaming apparatus, playing systems, and their method of their play that have as their general theme the assembly of technological devices and systems.

2. Description of the Prior Art

Numerous games are found in the prior art, each with its own particular architecture, balances of skill and chance, and potential to impart knowledge. In particular a great assortment of puzzles, model kits, and games are found each contributing a particular feature. The principal enjoyment of puzzles and model kits being the assembling of pieces into a completed picture or form.

Many games and toys have been developed over the years. Such games have ranged from the most simple to the extremely complex, and addresses a variety of themes. However, applicant is unaware of any puzzles or model kits that have the specific theme of computers and the assembling of computers.

Puzzles and model kits intended for young children are usually constructed of fewer and larger pieces. By so doing, the puzzle or model kit is easier to assemble, but can quickly lose its appeal. Where the continued successful assembly is a desirable objective, a second incentive must be provided to encourage the repeated utilization of the puzzle or model kit.

SUMMARY OF THE INVENTION

These and other shortcomings of the prior art are overcome by the various features of the present invention which are directed at puzzle sets, model kits, and playing system comprising puzzle games, board games, model kits, cards, toys, collectibles, and hobbies that imparts knowledge of the assembly of technological devices and systems.

For purposes of the present invention, various terms or nomenclature utilized in the art are defined as follows:

The terms "puzzle", "jigsaw puzzle", "puzzle game", and "puzzle set" are equivalent and interchangeable, are to be understood herein in the broadest possible sense, and are herein defined as any set or sets of pieces that can be assembled together, such as, for example, and not limitation: two dimensional surfaces, three-dimensional assemblies, electronic assemblies displayed on a video screen, and model kits. A "puzzle set" may comprise one or more complete sets of puzzles to provide for the playing requirements of one or more players. The "puzzle" pieces may be of a regular or irregular shape, and they may, or may not, be shaped responsive to the shape of the subject matter of the puzzle.

Where the term "jigsaw" is utilized to qualify the term "puzzle" it is not intended to limit the manner in which the "puzzle" is constructed, its design, or appearance. The term "jigsaw" is only intended to distinguish the puzzles of the present invention from "crossword puzzles".

The terms "game" and "playing means" as utilized herein are meant in the broadest possible sense and comprise puzzles, board games, card games, toys, collectibles, computer cards, model kits, and such other apparatus, components, elements, and materials as may be found a part of, or the entirety of an item available for sale at a toy store or a software store. Where not unambiguously inconsistent with the context, the terms "game", "playing means", and "playing apparatus" are equivalent and interchangeable.

The term "themed" as utilized herein refers to any one of a number of related themes of a device or system such as, for example, and not limitation: the device's technology, the manufacturing of the device, the internal architecture and assembling of the device, the device's components, history relating to the device, and trivia relating to the device.

The term "play" when qualifying an item, as in "play computer component", is used to clarify that the item is part of a game and is functionally distinguishes from its non-game counterpart. When the context requires, the non-game counterpart is qualified by the word "actual".

The term "logo" as used herein is intended in the broadest possible sense, and includes names, symbols, trademarks, signs, and any other mark which identifies an actual business entity, manufacturer, computer component manufacturer, computer manufacturer, and/or computer marketer.

The term "model kit" as used herein refers to any set of representative parts or representative components that may be assembled together. The representative parts or components may be only suggestive rather than scaled replicas of actual parts, components, or assemblies. In the broadest sense a "puzzle" is a "model kit"

The term "technological device" as used herein refers to any device, apparatus, system, or subsystem, such as, for example, and not limitation, a personal computer, an automobile, or a sailboat. References to specific devices are for purposes of explanation and not limitation.

Accordingly, it is an object of the present invention to provide gee participants an enjoyable gaming experience that imparts knowledge of the internal architecture and primary components of a technological device.

It is another object of the present invention to have game players gain familiarity with the assembling of technological devices.

It is yet another object of the present invention to impart game players specific knowledge as to the principles embodied in a device's technology.

It is yet another object of the present invention to acquaint game players with the meaning of terms relating to a device's technology.

It is yet another object of the present invention to acquaint the game players with the individuals who have made significant contributions towards the development of the technology.

It is yet another object of the present invention to acquaint game players with the names of some of the primary manufacturers of the technology.

It is yet another object of the present invention to gain the participation of manufacturers in subsidizing the costs of the games.

It is yet another object of the present invention to have the actual logos of manufacturers incorporated into the games.

Briefly these and other objects of the invention are accomplished by means of a number of puzzle sets, model kits, and board games relating to the assembling of a technology device. An assortment of games are shogun that introduce varying gaming opportunities, provide different balances between luck and skill, and are suitable to be enjoyed by a wide range of individuals.

The manufacturing and/or printing of the equipment and apparatus for the various puzzles, model kits, and games follow well known conventional practices and can be produced relatively inexpensively. The software-based games incorporate software and operating system technologies and standards of conventional characteristics.

The above mentioned and other objects, advantages, and features of the present invention, and the manner of attaining them, will become apparent, and the invention itself will be best understood by reference to the following detailed description of the embodiments of the invention in conjunction with the accompanying drawings, and appended claims that follow. For purposes of the disclosure, the description that follows is principally provided in terms of a personal computer as one example of a technological device.

DESCRIPTION OF THE PREFERRED EMBODIMENTS

Figure 1:
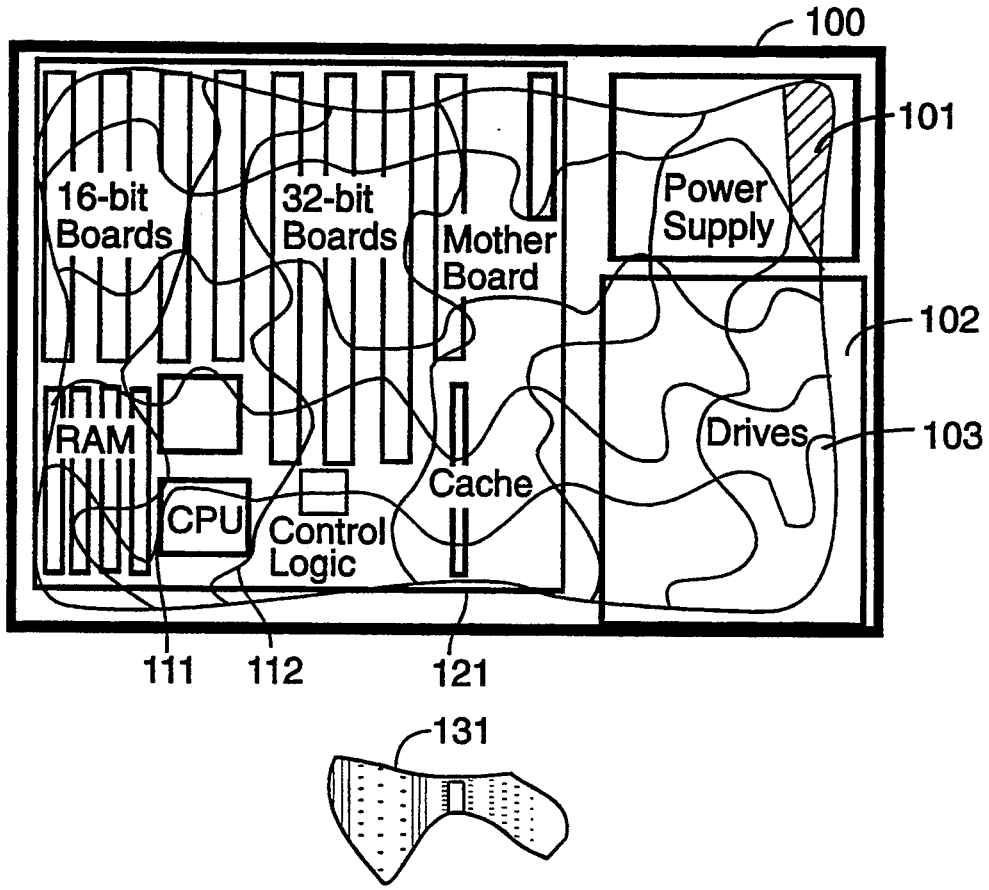
FIG. 1 is a plan view of a two-sided puzzle set of irregularly shaped pieces as per the present invention.

FIG. 1 is a plan view of a two-sided puzzle set of irregularly shaped pieces as per the present invention. The puzzle set may be conventionally manufactured of cardboard, wood, plastic, or any other suitable material. The image may be direotly or indirectly incorporated into the surface of the material by any of a number of conventional methods.

Turning now to the construction of the puzzle set 100 as shown in FIG. 1, the puzzle optionally includes a base or backing, shown partially as a cross hatched section 101, and a frame or border 102 secured thereto in a conventional manner, thereby forming an enclosure for holding the plurality of individual puzzle pieces 103. The construction of the puzzle pieces and the base is conventional. It is noted that in a preferred embodiment, specially where the number of puzzle pieces is large and generally intended for a more skilled player, the base 101 and border 102 are not a part of the puzzle set.

The enhancements as per the present invention to the puzzle set 100 above detailed comprises the technology-themed design of a technological device. Specifically, in a preferred embodiment, an illustration or photograph of the internal architecture of a personal computer 111 is provided on the upper or top surface of the puzzle pieces. Additionally, each of the significant elements, components, assemblies, or sub-systems found in a personal computer may be specifically identified by appropriate labels 112.

Thus, the puzzle set of the present invention represents a novel means of acquainting the player with the internal architecture of a personal computer.

It is noted that a number of different computer and electronic motifs are contemplated in a variety of views and representations. For example, the illustration of the puzzle set may be limited to the mother board 121, or comprise a multi-user mainframe-based computer network.

It is also contemplated that complementary illustrations be placed on both sides of the puzzle pieces. This is represented in FIG. 1 as the face down piece 131. In the case of the motherboard the back side illustration, limited to printed circuits and solder points, would be easily distinguished from the front side illustration of the highly populated printed circuit board. The back side illustration would add a degree of difficulty to the assembling of the front face illustration of the puzzle, and provide in itself a much more challenging puzzle for those individuals who may wish to assemble the back face illustration. In the latter case the front face may be utilized by the player to obtain a hint of where the piece may belong.

Figure 2:
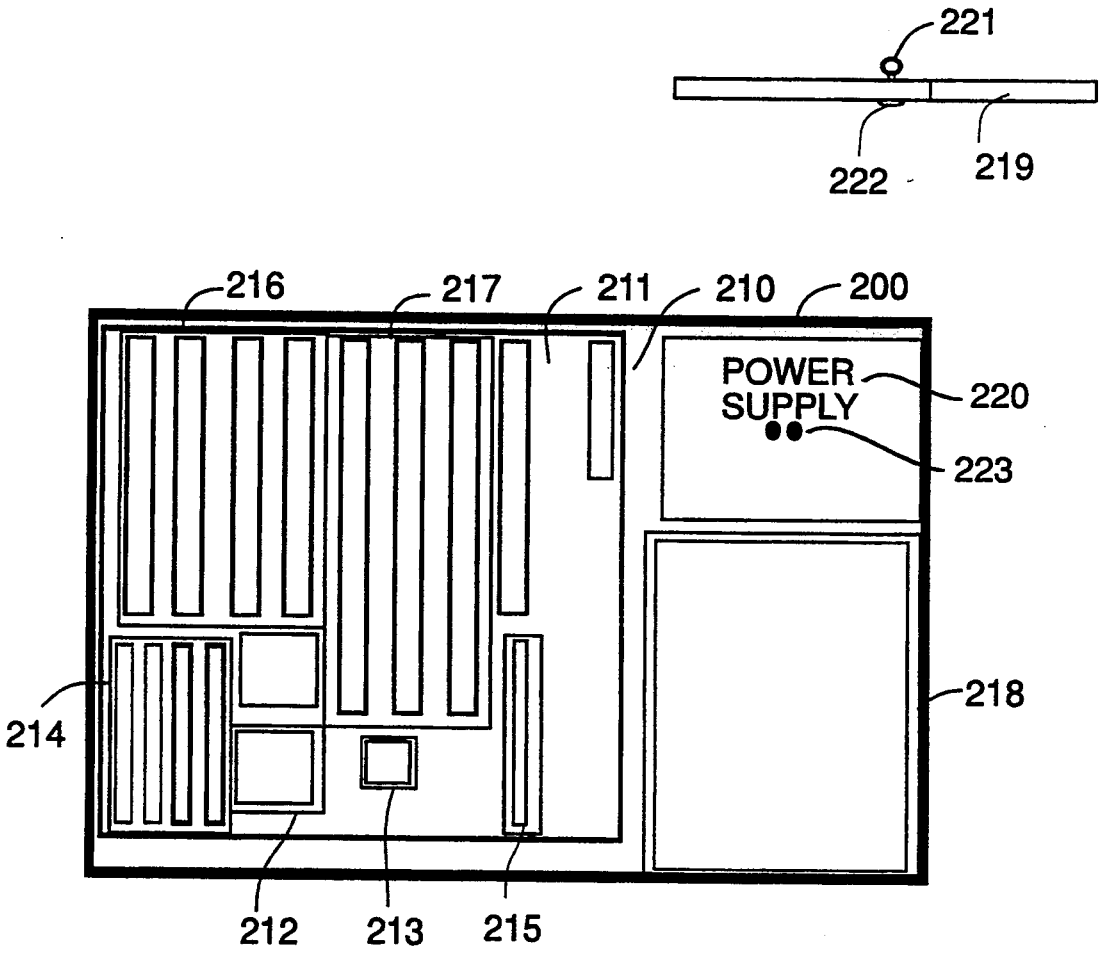
FIG. 2 is a plan view of a puzzle set of representative shaped pieces as per the present invention.

FIG. 2 is a plan view of a jigsaw puzzle of representative shaped pieces as per the present invention. The jigsaw puzzle 200 of FIG. 2 is differentiated from the jigsaw puzzle detailed in FIG. 1 in that the shape of the puzzle pieces follow the contour of the components illustrated on the front face of the puzzle. In this embodiment, the Mother Board 211, CPU 212, Control Logic 213, RAM 214, Cache 215, 16-bit Boards 216, 32-bit Board 217, Drives 218, and Power Supply 219, are each represented by separate puzzle pieces.

Each of the puzzle pieces 211-9 are fitted into the appropriate one of the compartments of the multi-compartment frame 210. The construction of the multi-compartment frame 210 is similar to that of the frame detailed with respect to FIG. 1. The names of the components represented by the puzzle pieces are printed on the base of the frame in their respective compartments. For example, the label "Power Supply" 220 is applied to the compartment where the power supply piece 219 is to be placed. As this embodiment is designed principally for younger players, each of the puzzle pieces is provided with a small knob 221 to facilitate lifting the piece.

In a preferred embodiment, it is also contemplated that at least one, more than one, or all of the puzzle pieces serve to complete an electrical circuit powered by an electrical means, as, for example, a replaceable battery or solar panel, such that when a sufficient number of the required puzzle pieces are inserted, an appropriate video or audio display is produced. As an example of a means of completing the circuit, the underside of each puzzle piece comprises an electrical conductor 222 than when inserted into its compartment bridges open points 223 on the base of the board. The electrical conductor 222 can be a part of, or applied to, the fastening device of the small knob 221.

This particular puzzle is suitable to play the puzzle-game shown in the patent to Guill, U.S. Pat. No. 4,417,732, the teachings of which are by reference incorporated herein. Alternatively to the roll of the dice, questions cards, detailed further below, may be utilized as part of the competitive play of the puzzle game.

Figure 3:
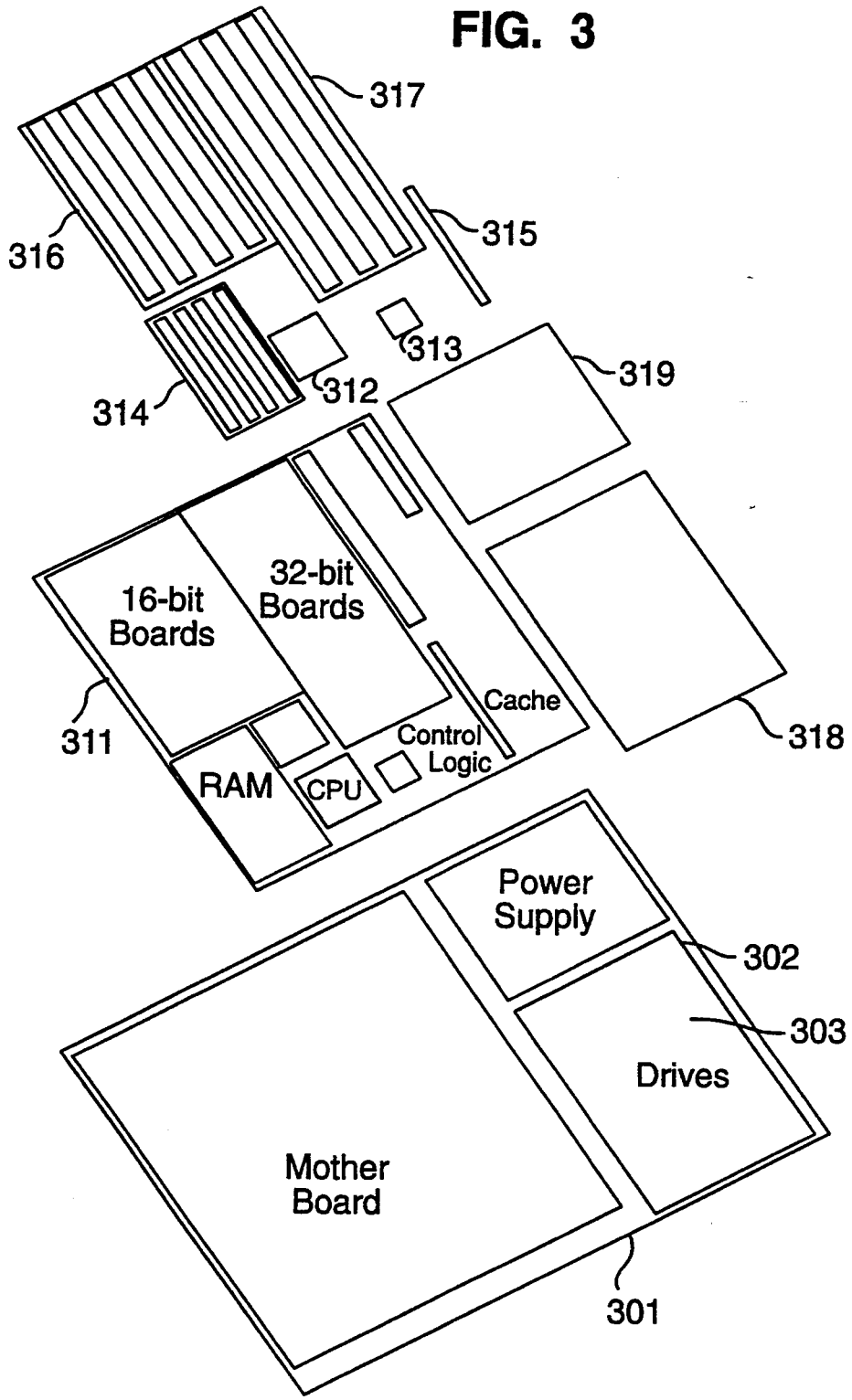
FIG. 3 is a plan exploded view of an assembly set as per the present invention.

FIG. 3 is another example of a technology-themed playing means for providing technology-themed playing to at least one player and wherein said technology-themed playing means comprises assembly pieces categorized as either puzzle set pieces or model kit pieces; and wherein at least one piece of said assembly playing means is representative of a component of a technological device such as, for example, a computer, or an automobile. For purposes of clarity FIG. 3 is drawn as a simplified plan view, it is intended to be understood as both a two-dimensional scaled puzzle set and a three-dimensional scaled model kit. In that regard the term "assembly piece" is to be understood as comprising a piece of a puzzle set, and a piece (part) of a model kit. Where a specific kind of assembly piece or component is cited it is for purposes of explanation and not limitation.

In the assembly set of FIG. 3, the frame detailed previously is replaced by a base 301. In a computer-themed embodiment, the base 301 is representative of a personal computer's frame or case. (In an automobile-themed embodiment the base is representative of an automobile's free.) Superimposed on the representation of the case are the outlines 302 and identities 303 of the assembly pieces representative of the components accommodated by a personal computer's case.

Certain assembly pieces such as, for example, the mother board 311 are both an assembly piece and a base. As a base, the mother board comprises the outlines and identities of the assembly pieces representative of the components accommodated by a personal computer's mother board.

FIG. 3 shows a number of individual pieces representative of a personal computer's components comprising: microprocessor or CPU 312, Control Logic 313, RAM 314, Cache 315, 16-bit boards (slots) 316, 32-bit boards (slots) 317, drives 318, and power supply 319.

The complexity and number of assembly pieces may be increased to accommodate a variety of gaming requirements and objectives. Further, the actual construction of the assembly pieces may be executed as a three-dimensional jigsaw puzzle in a manner analogous to that shown in the patent to Schoen, U.S. Pat. No. 5,178,391, the teachings of which are by reference incorporated herein.

A particularly ingenious puzzle system is shown in the patent to Moreau, U.S. Pat. No. 3,779,558, the teachings of which are by reference incorporated herein. Moreau teaches "A puzzle comprising a plurality of pieces which can be assembled in more than one configuration, either as a three dimensional recognizable shape or as a two-dimensional surface which presents a graphic representation." In a technology-themed embodiment this particular puzzle construction would provide for the three-dimensional buildup suggested by FIG. 3, and also as an exploded view providing greater detail of such components as the mother board, disk drives and power supply.

Figure 4:
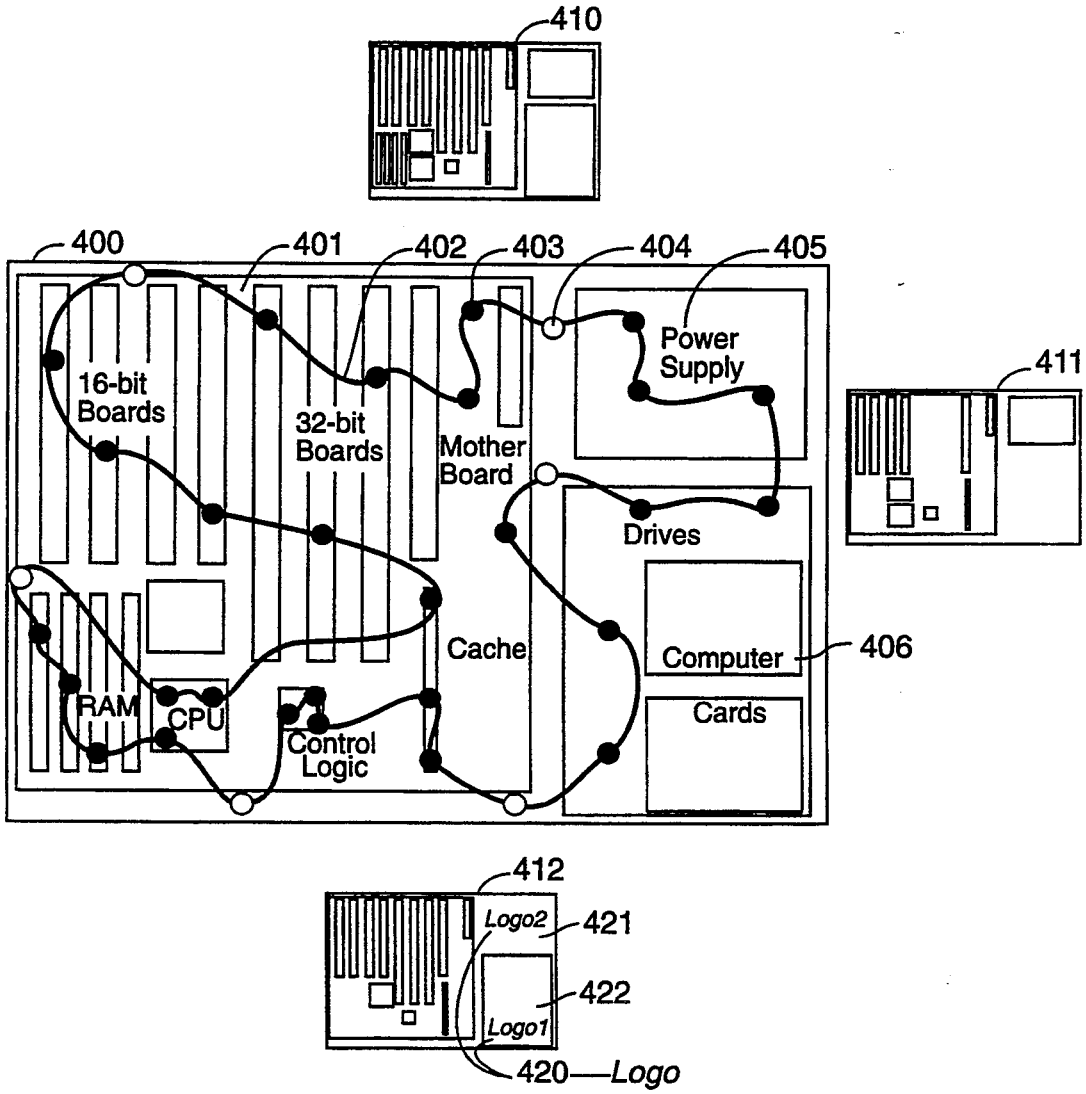
FIG. 4 is a plan of a board game comprising a gameboard and assembly sets as per the present invention.

Referring now to FIG. 4, illustrated is a board game, the playing object of which is to be the first player to accumulate one of each of the components required to complete the assembly of the technological device.

Obtaining of the necessary components is principally a result of the player's marker landing in the appropriate component spaces, and thereby obtaining the required pieces to complete the assembly. Specifically, illustrated in FIG. 4 is a gameboard 400 example of a surface providing means for providing players with assembly or component pieces from the puzzle set and/or model kits. The gameboard 400 comprises an illustration provided thereon that combines a technology-themed illustration 401 and a player marker travel path 402.

The technology-themed illustration 401 corresponds to the assembly pieces provided in each of the players' model kits or puzzle sets 410–412. In this example, the illustration 401 of the board is similar to the representations detailed with respect to FIGS. 1, 2 and 3, and is an open case display of the internal architecture of a personal computer.

The continuous pathway 402 connecting thirty-four player marker landing positions, of which twenty-eight positions (filled circles) 403 are associated with a computer component, and six positions (unfilled circles) 404 are associated with a deck of question cards. Each of the component spaces 403 is associated by location with one of a nine computer components identified by a corresponding label 405. To further identify the component spaces, the color of each of the labels 405 identifying the computer components and the corresponding component spaces 403 are of the same color.

Optionally, the gameboard further comprises areas 406 designated for the deck of the question cards herein referred to, and detailed below, as computer cards. Further, it is also noted that the gameboard 400 may be executed as a three-dimensional object, wherein the continuous pathway 402 follows the various levels.

The players computer model kits or puzzle sets 410–412 are examples of a themed playing means for providing technology-themed playing and representing assembly components, and are shown in FIG. 4 at different stages of completion. For each component identified in the gameboard 405 there is a corresponding three-dimensional scale model assembly piece or puzzle piece for each of the assembly sets 410–412.

Figure 5:
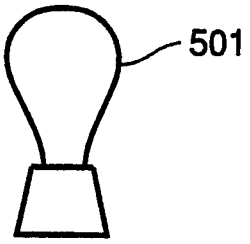
FIG. 5 is a perspective view of a representative player marker means.

FIG. 5 is a perspective view of a representative player marker means for identifying the position of a player on a gameboard. The player markers 501 are distinguishable from one another to provide easy identification of the user thereof. This particular marker 501 is constructed of suitable durable material to resemble a light bulb, and is provided in several different colors. The markers may differ in various respects such as color, size, shape, or other characteristics.

Figure 6A:
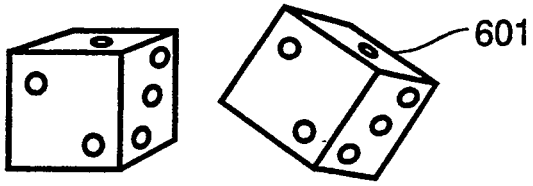
FIG. 6A is a perspective view of a pair of dice.

FIG. 6A is a perspective view of a pair of dice 601 representative of a first random movement generating means for randomly determining a movement of a player's marker means.

Figure 6B:
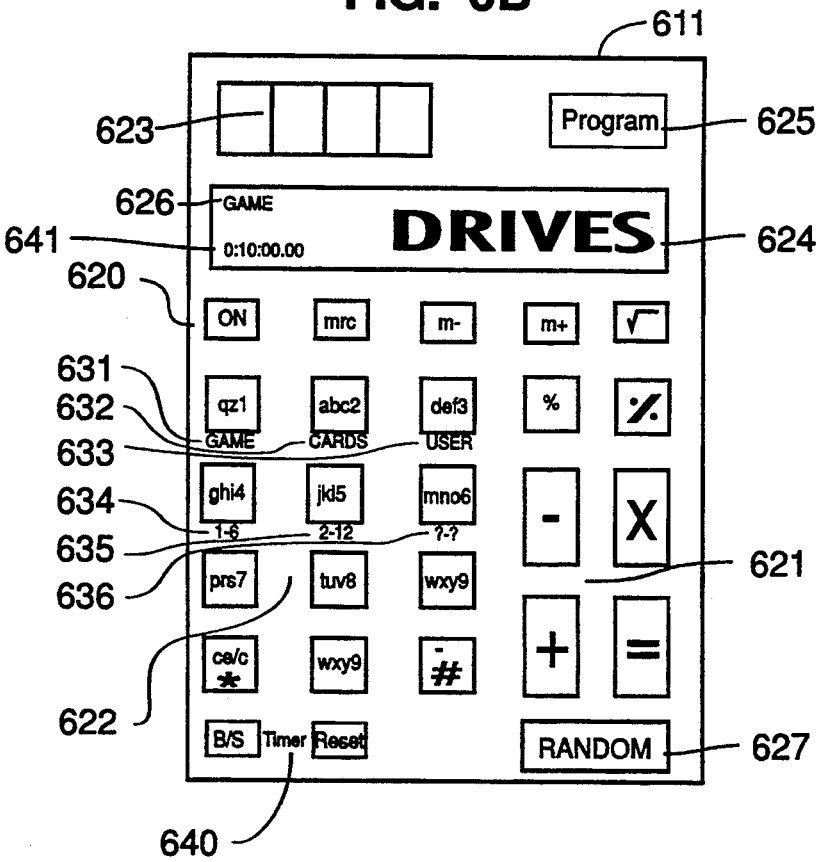
FIG. 6B is a block diagram of a random generator electronic device.

FIG. 6B is a block diagram of an electronic solar powered hand calculator device 611 wherein the logic device is enhanced to produce random numbers, characters, programmed set of characters, and/or symbols. The device, herein referred to as a random generator 611, is representative of a second random movement generating means for randomly determining a movement of a player's marker means, is also representative of a means for introducing playing situations, and is also a providing means for providing players with pieces from puzzle set and/or model kit.

In a preferred embodiment, the random generator 611 comprises the designs and functions of a conventional handheld calculator. This is diagrammatically shown by the functions keys 621. The alpha-numeric keypad 622, implementing the 123 layout, facilitates the entry of numeric and alpha characters. The device is conventionally powered by a solar panel 623, or alternatively by a replaceable battery. The display 624 comprises alpha-numeric and symbol capabilities.

The gaming functions are obtained by means of a program key 625 and random activator key 627. In addition to the preprogrammed standard set of random categories such as: the requirements of the games herein described (GAME) 631, 52 card deck (CARDS) 632, one die (1–6) 634, two dices (2–12) 635, any number range (?–?) 636; a nonvolatile memory stores the user entered elements 633.

The program key 625 may be configured to cycle through the capabilities, eliminating the requirements of the separate labels 631–636. Additionally, it is noted that for purposes of the present games, the calculator function keys 621 and the alpha-numeric keys 622 are not required, and in a dedicated device the keys and associated functions may be omitted. In its simplest embodiment, the device is executed as a dedicated electronic random means for generating a random output.

To utilize the random generator 611, the device is first activated by pressing the "ON' key 620, and selecting by means of the "Program" key 625 the desired routine 626. Thereafter, each player when required presses the "RANDOM" key 627, upon which the device responds by displaying 624 a randomly generated output consistent with the routine selected 626.

As illustrated, in response to the selection of the "Game" routine 626 by means of the "program" key 625, the device would respond by displaying 624 the name of a computer component, as illustrated. This option is particularly intended to facilitate playing without requiring the use of the gameboard. Similarly if a two dice routine is selected, the device would respond with a randomly selected number in the 2–12 range.

The random generator is illustrated as additionally comprising conventional stop watch/timer functions 640 and display 641, running independently of the other functions.

Figure 7A:
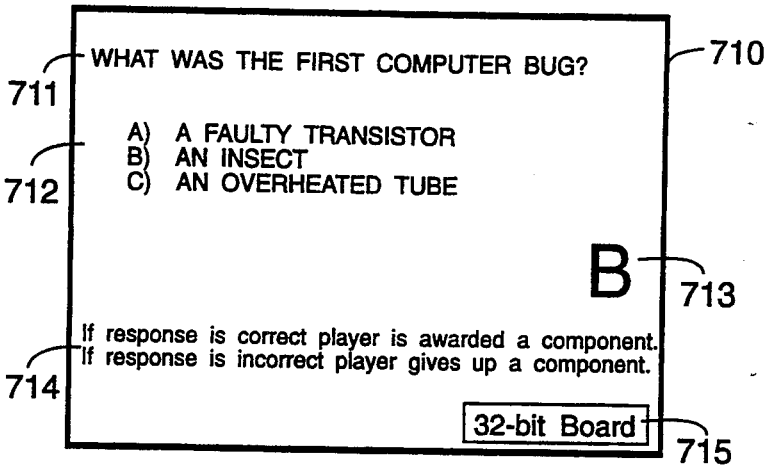
FIG. 7A is a plan view of a representative card means for introducing playing situations.

FIG. 7A is a plan view of a representative card means for introducing playing situations. Each of the computer cards 710 comprises a question 711 relating to computers. In addition to the question 711, a computer card provides three answers 712 from which the player being queried may select what he/she believes is the correct answer. The correct answer is indicated on the card 713, as well as the instructions 714 corresponding to a correct answer and corresponding to an incorrect answer. The questions 711 included in computer cards 710 are selected from a wide variety of categories ranging from the trivial to the specifically technical. Optional card packets may be made available to the purchaser of the game, each suitable for different groups of individuals and particular expertise or interest.

In a preferred embodiment the specific design of the cards is directly associated with the gaming requirements such that the cards serve as playing means for providing players with component pieces from the component assembly set. As shown in FIG. 7A, this is accomplished by providing on the card an identification of component piece 715 which the card entitles the cardholder.

A set of these cards would eliminate the requirement of a gameboard and related pieces by indicating thereon the particular component piece or privilege that the player drawing the card is entitled to. The card means may serve both as playing means for introducing playing situations and as playing means for providing players with component pieces from the assembly set.

Clearly, where the theme of the game is, for example, automobiles, the cards designs would also preferably comprise an automobile theme.

The proposed rules of a technology-themed board game, suitable for persons from five to eight years of age, are as follows:

BEGINNING OF RULES

Object

The object of the game is to become the first player to obtain one of each of the component pieces required to complete assembling his/her set.

Game Pieces

The game pieces consists of a gameboard, two dice, player markers, frame pieces, assembly pieces, and cards.

Distributor

The players select a person to act as distributor- If the distributor is also a player, the distributor must keep the player and distributor pieces separate.

The distributor distributes assembly pieces and usually reads the card.

Set Up

Each player selects a player marker to represent his/her travel around the board, and receives a frame piece.

All remaining game pieces remain with the distributor.

The players will agree on whether movement of a player's marker will be permitted in either a clockwise or counterclockwise direction as selected on each turn by the player.

The players will agree on whether they will utilize the cards in the game. If the players agree to utilize the cards, the cards are shuffled and placed face-down on the gameboard.

To Start

Each player in turn rolls the dice. The player with the highest total begins the play by placing his/her marker on any of the open spaces (white circles) on the board.

After a player has completed his/her turn the play passes to the player on his/her left.

A player's marker remains on the space occupied and proceeds from that space on the player's next turn.

Player's Turn

On each turn a player rolls the dice and moves his/her marker the number of spaces equal to the sum of the dice.

If the player represented by the marker lands on one of the component spaces (filled circle), the player obtains an assembly piece corresponding to that space.

If the player represented by the marker lands on a space occupied by another marker, the current turn's player can select an assembly piece from the other player whose marker is on that space. On this basis, two or more player markers may occupy the same space.

A player cannot have at one time two of the same assembly pieces.

Cards

If the players have agreed at the outset to utilize the cards in the game, then if the player represented by a marker lands on an open space, the player must request the distributor to select the top card from the deck and to query him/her. If the distributor is the player, a person opposite him/her conducts the query.

If the player selects the correct answer, he/she is awarded an assembly piece of his/her choice. If the player selects the incorrect answer, he/she must surrender an assembly piece to the distributor. If unable to do so, the player forfeits the next turn.

If the players have agreed at the outset not to utilize the cards in the game, then if the player represented by a marker lands on an open space, there is no gain or loss of assembly pieces.

Declaring a Winner

At the instant that a player has one each of the required assembly pieces to complete the assembling of the set, he/she is declared the winner.

END OF RULES

The above rules of the games are one example of instruction means for establishing objects of the playing of the games of the present invention. They apply equally whether the assembly pieces are two-dimensional puzzle pieces representative of components or three-dimensional scale model replicas of components. Further, the rules are intentionally not specific as to whether the components are representative of computer components or automobile components, and apply equally well to, for example, an automobile-themed board design and model replicas/puzzle pieces.

A number of variations of the basic rules are possible, for example, on every instance a correct response to the card may be required to obtain an assembly piece.

The various assembly sets embodiments detailed hereinabove are further examples of technology-themed playing means for providing technology-themed playing to at least one player. Specifically, the assembly sets are examples of computer-themed playing means for providing computer-themed playing to at least one player. The first examples known to the applicant of computer-themed playing means are provided in a prior patent application (Ser. No. 08/042,590) filed on Apr. 3, 1993, by the present inventor titled: "Computer-Themed Playing System". It is specifically intended that the teachings of said prior patent application, and any features disclosed therein that are pertinent to the present invention, are by reference incorporated herein. To that extent and for purposes of disclosure, the full text and FIGS. of said prior patent application are by reference incorporated herein.

It is also intended that other features from said prior patent application will be combined with the inventive elements specific to this application. The preferred embodiment detailed above with respect to FIG. 4 is one example of the many possible contemplated combinations of the teachings specific to this application with the various teachings of the "Computer-Themed Playing System". Rather than duplicate the board design and game rules detailed in the "Computer-Themed Playing System" application, and as suggested in the application, the board design and board game rules detailed above with respect to FIG. 4 comprises a simpler board and gaming architecture.

A great number of other combinations are possible, such as, for example, and not limitation: i) integrating the corporate sponsorship into the board game and scale models/puzzle set designs; ii) utilizing collectable cards rather than the simpler cards; iii) executing the various puzzle games and combinations as technology-themed software games; and iv) integrating the puzzles into the playing system. Each of these are briefly detailed below.

Referring once more to FIG. 4, as detailed in the prior patent application, to encourage corporate sponsorship, the names or logos 420 of the component or system manufacturers are incorporated into the representation of the assembly pieces. In a preferred embodiment each of the assembly pieces 422 and frame pieces 421 are associated with the logo 420 of an actual manufacturer. Alternatively, only each of the frames 421 are associated with the logo 420 of a manufacturer.

Figure 7B:
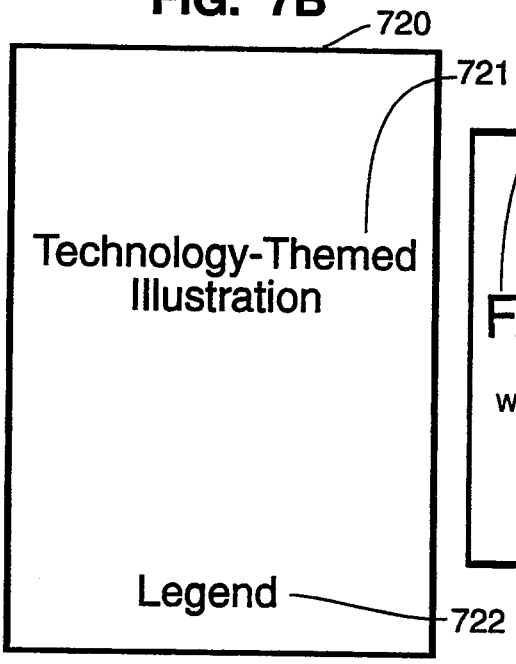
FIGS. 7B and 7C are plan views of a technology-themed collectable card.
Figure 7C:
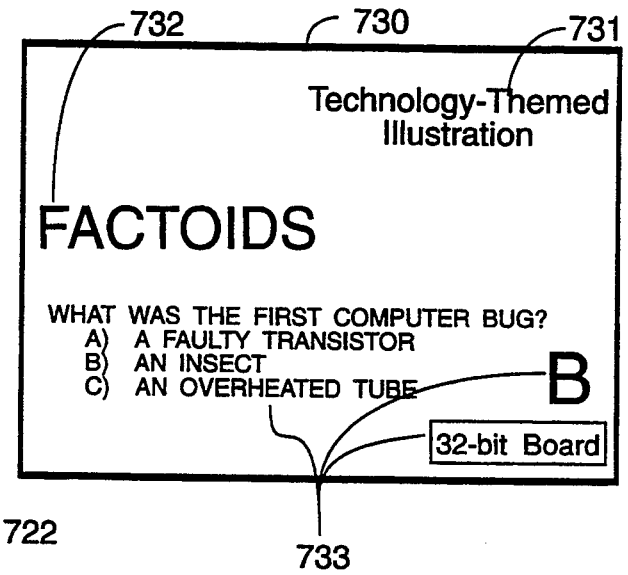

Clearly, the cards previously detailed herein with respect to FIG. 7A, and as detailed in the prior patent application, may be of a construction, quality, and design equivalent to collectable cards. Referring now to FIG. 7B, illustrated is a representation of the face 720 of a technology-themed collectable card comprising, in this example, an illustration or photograph of a computer related subject 721 and legends 722 in a manner similar to the front face of baseball cards. The back face 730 of the technology-themed collectable card, as shown in FIG. 7C, comprises an illustration 731, factoids 732, and game requirements 733.

The technology-themed collectable cards, as the card means previously detailed, may serve both as playing means for introducing playing situations, and as playing means for providing players with component pieces from the scale model kits or the puzzle sets. In such an embodiment the motif on the face of the card is designed not to disclose the cards gaming consequences.

Figure 8:
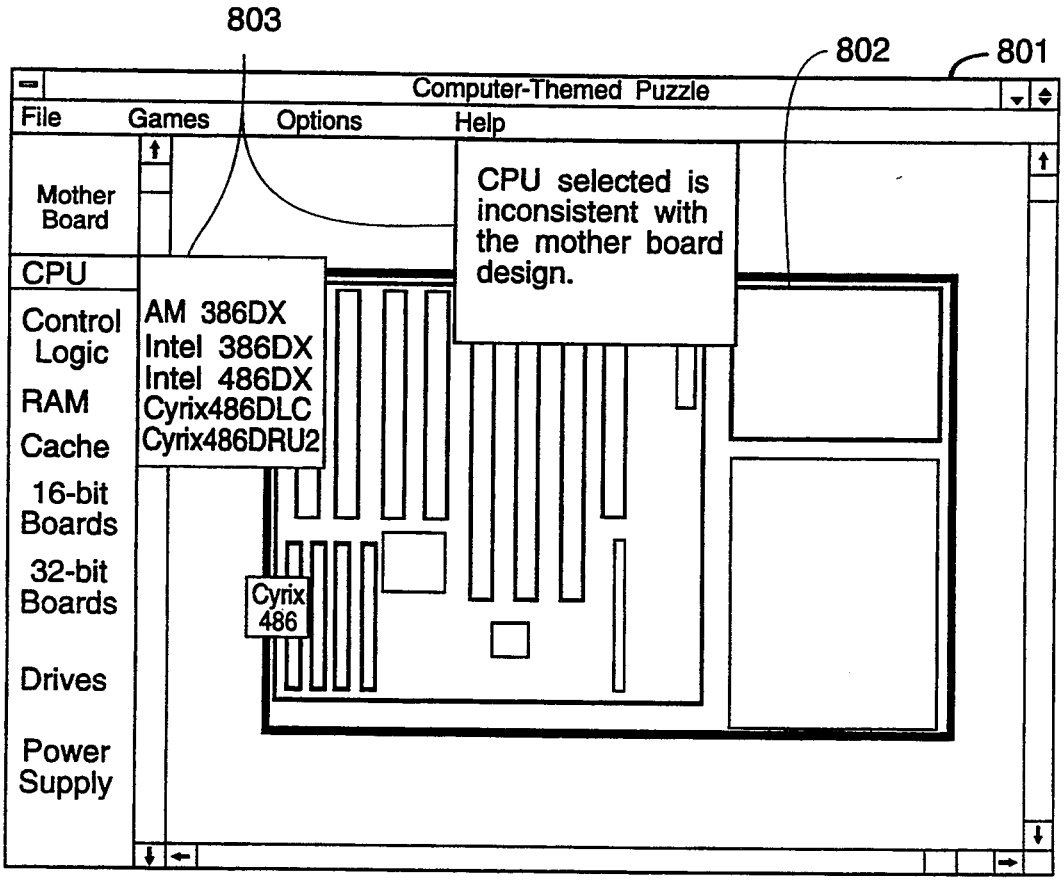
FIG. 8 is a representation of a software generated video screen as per the present invention.

Similarly, FIG. 8 represents in simplified form one of the monitor screens 801 generated by a technology-themed software-based game. Specifically, the software-based game is the electronic embodiment of the computer-themed game detailed above. In this example, the assembly pieces 802 are executed in computer code as three-dimensional scale replicas. The software incorporates the advantages of a "Windows" GUI. In that respect, teachings of software puzzle games such as, for example, "TetraVex" Copyright (C) 1991 Microsoft Corp., and the teachings of structure programs such, as for example, FormWorx Form Publisher Copyright (C) 1988–1990 FormWorx Corp, are by reference incorporated herein. In addition to the gaming aspects, the software version provides the opportunity for the implementation of sophisticated on-line educational routines, help, and instructional screens 803. Labels incorporated in the assembly pieces of FIGS. 2 and 3 are optionally omitted by the player.

In the most preferred embodiment, substantially all the playing means herein detailed and incorporated by reference comprise a single fully integrated technology-themed playing system comprising playing means from more than one category and providing the purchaser an extensive variety of creative playing opportunities. In that regard, FIG. 4 is also representative of a technology-themed playing system comprising a first playing means (board game) for providing technology-themed playing to at least one player, and wherein said playing means is categorized in a first game category (board games); a second playing means (scale model kits, jigsaw puzzle sets, and/or collectable cards) for providing playing to at least one player, and wherein said playing means is categorized in a second game category (scale model kits, jigsaw puzzle sets, and/or collectable cards respectively) different from said first game category (board game); and integration means for integrating the playing of said first playing means with the playing of said second playing means.

It is contemplated that each of the playing means or subsystems, such as, for example,: puzzles, collectable cards, board games, and model kits are individually packaged and marketed, and also combined and marketed as system packages.

Instructions and rules for playing the various games and embodiments detailed and/or suggested herein are intended to maximize the enjoyment and challenge of the playing system. A number of options are provided to meet the particular gaming desires of the players, and the games themselves have an inherent flexibility that provide for the creative departure from the detailed rules which each of the game's packages would include.

It will be understood that the rules of the games, methods of play, and specifics detailed above are subject to variations within a wide range. It is also noted that a number of elements included have no significant reason for their inclusion other than the particular inclinations of the applicant. Additions, deletions, and integrations can be freely made without altering the underlying theme of the playing means of the playing system of the present invention.

Clearly, certain aspects and features of the puzzle sets, model kits, and board games can be expanded beyond the embodiments shown above. For example, as in the patent to Bianchi, U.S. Pat. No. 5,149,098, the teachings of which are by reference incorporated herein, certain games pieces have an unique indicia which would cause the puzzle sets of all the players being shifted one player position. The puzzle detailed with respect to FIG. 1 may be adapted as per the teachings of the patent to McFarland, U.S. Pat. No. 3,558,136, which are by reference incorporated herein, to provide two or more players competitive and strategic gaming opportunities.

Further, the card games herein detailed may be modified to incorporate the teachings of the patent to Hernandez, U.S. Pat. No. 5,141,235, which are by reference incorporated herein. In such an embodiment, the educational card game is adapted to be played on a technology-themed gameboard rather than the geographical gameboard shown in Hernandez.

Thus it is apparent that there has been provided in accordance with the invention a technology-themed playing system, and more particularly games which may be played as a jigsaw puzzle, puzzle-based board game, card game, model kit game, model kit-based board game, and/or software game for purposes of entertainment and education that fully satisfies the objectives, aims, and advantages set forth above. While the invention has been detailed in conjunction with specific embodiments thereof, it is evident that many alternatives, modifications and variations, as shown and suggested above, will be apparent to those skilled in the art in light of the foregoing description. Accordingly, it is intended to embrace all such alternatives, modifications and variations as fall within the spirit and broad scope of the invention. It is noted that the prior art that has been cited herein is offered by way of example and not limitation.

Since the prior art is well established, and many of the features, components, and methods found therein may be and are incorporated in the preferred embodiment; and since other modifications and changes varied to fit particular playing requirements and environments will be apparent to those skilled in the art, the invention is not limited to the presently preferred forms of the present invention set forth here and above, it is to be understood that the invention is not limited thereby. It is also to be understood that the specific details shown are merely illustrative, and that the invention may be carried out in other ways without departing from the spirit and scope of the following claims.

What is claimed is:

1. A board game apparatus comprising:

a plurality of model computer components representing a plurality of components of an actual computer;

assembly means for assembling said plurality of model computer components to produce an assembled model of said actual computer;

said plurality of model computer components including a model case for retaining and yielding at least some of said plurality of model computer components therein and therefrom;

said plurality of model computer components further including a model motherboard for retaining and yielding at least some of said plurality of model computer components therein and therefrom;

gameboard means for defining a playing area, said playing area including a plurality of identified player positions disposed in spaced relation to one another and defining a pathway, at least some of said player positions being located within one of a plurality of component areas within said playing area, each of said component areas including identification means for identifying one of said plurality of model computer components, said playing area further including direction means for assembling said plurality of model computer components;

marker means for identifying a position of a player on said gameboard;

marker movement generating means for determining an amount of movement of said markers along said pathway; and instruction means for establishing the distribution of model computer components as a player's marker progresses about said pathway.

2. The board game apparatus of claim 1, further comprising:

electrical conductor means for conducting an electric current therethrough and defining an electrical circuit;

electrical contact means for closing said electrical circuit when said plurality of model computer components are completely and correctly assembled, thereby permitting said electric current to flow through said electrical circuit; and indicator means activated by said electric current when said electrical circuit is closed for indicating complete and correct assembly of said assembled model.

3. The board game apparatus of claim 1, further comprising logo means for identifying at least one manufacturer of an actual computer component.

4. The board game apparatus of claim 1, wherein said player marker movement generating means electronically provides a name randomly selected from the names of each of said plurality of model computer components.

5. A board game apparatus comprising:

a plurality of model computer components representing a plurality of components of an actual computer;

assembly means for assembling said plurality of model computer components to produce an assembled model of said actual computer;

said plurality of model computer components including a model case for retaining and yielding at least some of said plurality of model computer components therein and therefrom;

said plurality of model computer components further including a model motherboard for retaining and yielding at least some of said plurality of model computer components therein and therefrom;

electrical conductor means for conducting an electric current therethrough and defining an electrical circuit;

electrical contact means for closing said electrical circuit when said plurality of model computer components are completely and correctly assembled, thereby permitting said electric current to flow through said electrical circuit;

indicator means activated by said electric current when said electrical circuit is closed for indicating complete and correct assembly of said assembled model;

logo means for identifying at least one manufacturer of an actual computer component;

gameboard means for defining a playing area, said playing area including a plurality of identified player positions disposed in spaced relation to one another and defining a pathway, at least some of said player positions being located within one of a plurality of component areas within said playing area, each of said component areas including identification means for identifying one of said plurality of model computer components, said playing area further including direction means for assembling said plurality of model computer components;

marker means for identifying a position of a player on said gameboard;

marker movement generating means for determining an amount of movement of said markers along said pathway; and instruction means for establishing the distribution of model computer components as a player's marker progresses about said pathway.

6. The board game apparatus of claim 5, wherein said player marker movement generating means electronically provides a name randomly selected from the names of each of said plurality of model computer components.

7. A board game apparatus comprising:

a plurality of model computer components representing a plurality of components of an actual computer;

assembly means for assembling said plurality of model computer components to produce an assembled model of said actual computer;

gameboard means for defining a playing area, said playing area including a plurality of identified player positions disposed in spaced relation to one another and defining a pathway, at least some of said player positions being located within one of a plurality of component areas within said playing area, each of said component areas including identification means for identifying one of said plurality of model computer components, said playing area further including direction means for assembling said plurality of model computer components;

marker means for identifying a position of a player on said gameboard;

marker movement generating means for determining an amount of movement of said markers along said pathway, said marker movement generating means electronically provides a name randomly selected from the names of each of said plurality of model computer components; and instruction means for establishing the distribution of model computer components as a player's marker progresses about said pathway.

* * * * *